US005407086A

United States Patent [19]

Ota et al.

[11] Patent Number: 5,407,086

[45] Date of Patent: Apr. 18, 1995

[54] BOTTLE

[75] Inventors: Akiho Ota, Koto; Takao Iizuka, Matsudo, both of Japan

[73] Assignee: Yoshino Kogyosho Co., Ltd., Tokyo, Japan

[21] Appl. No.: 107,169

[22] Filed: Aug. 17, 1993

[30] Foreign Application Priority Data

Aug. 21, 1992 [JP] Japan ..... 4-223087

[51] Int. Cl.[6] ..... B65D 23/00

[52] U.S. Cl. ..... 215/1 C; 220/675; 220/673

[58] Field of Search ..... 215/1 C; 220/675, 673, 220/671, 670

[56] References Cited

U.S. PATENT DOCUMENTS

| | | | |
|---|---|---|---|
| 4,805,788 | 2/1989 | Akiho | 215/1 C |
| 4,863,046 | 9/1989 | Collette et al. | 215/1 C |
| 5,092,475 | 3/1992 | Krishnakumar et al. | 215/1 C |
| 5,178,289 | 1/1993 | Krishnakumar et al. | 215/1 C |
| 5,199,588 | 4/1993 | Hayashi | 215/1 C |
| 5,341,946 | 8/1994 | Vailliencourt et al. | 215/1 C |

FOREIGN PATENT DOCUMENTS

| | | | |
|---|---|---|---|
| 62-52032 | 3/1987 | Japan . | |
| 62-177613 U | 11/1987 | Japan . | |
| 63-70913 U | 5/1988 | Japan . | |
| 1-144309 U | 10/1989 | Japan . | |
| 1-176015 U | 12/1989 | Japan . | |
| 3-15339 U | 2/1991 | Japan . | |
| 3-64206 U | 6/1991 | Japan . | |
| 3-84738 U | 8/1991 | Japan . | |
| 3-289435 | 12/1991 | Japan | 215/1 C |
| 9100829 | 1/1991 | WIPO | 215/1 C |

*Primary Examiner*—Allan N. Shoap
*Assistant Examiner*—Stephen Cronin
*Attorney, Agent, or Firm*—Oliff & Berridge

[57] ABSTRACT

A bottle has a high strength against pressure-reduction without reducing the internal content. The bottle is made up of a circular bottom; a barrel portion extending upwardly from the outer peripheral edge of the bottom portion; and a plurality of recessed portions each having a longitudinal and approximately rectangular shape, which are spaced from each other along the circumferential direction of the barrel portion. Each of the recessed portions includes a recessed panel surface fallen in from the barrel portion by a specified stepped dimension and two pieces of swelling bodies that swell in the outer peripheral direction from the recessed panel surface by a specified height. Two of the swelling bodies, each being formed into a trapezoidal shape having a flat upper end surface, are longitudinally spaced from each other along the longitudinal length of the bottle.

10 Claims, 11 Drawing Sheets

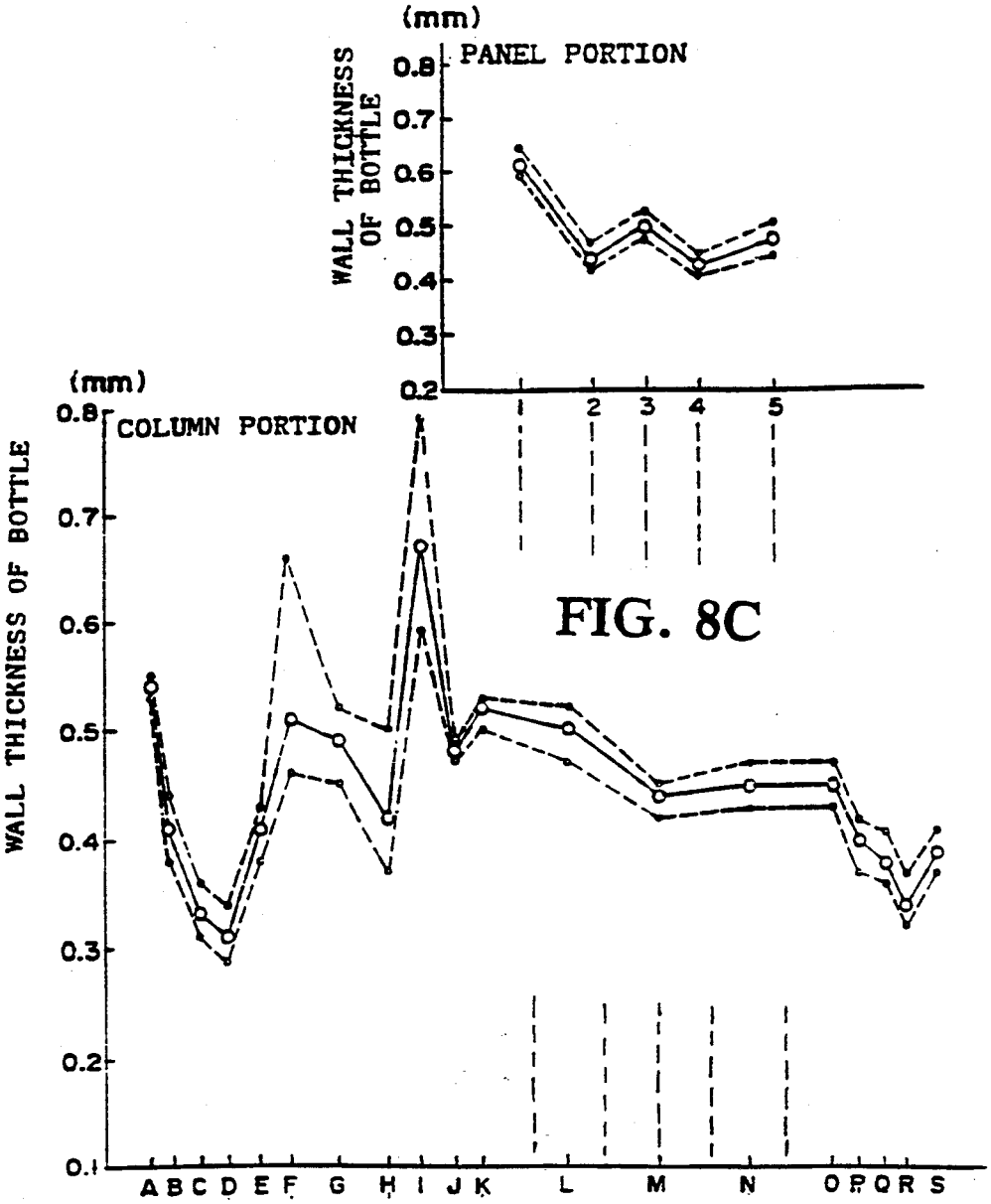
FIG. 8C
FIG. 8B
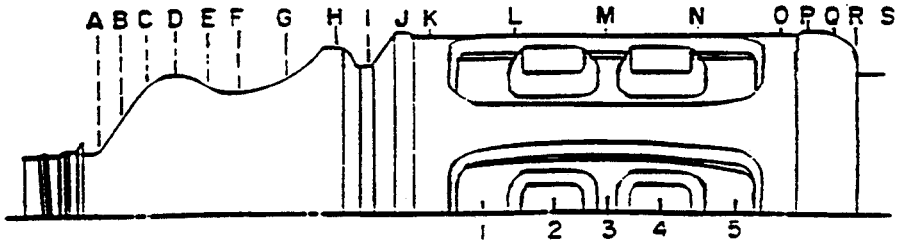
FIG. 8A

BOTTLE

BACKGROUND OF THE INVENTION

The present invention relates to a synthetic resin made bottle, and more particularly to a blow molded bottle having a specified panel design for absorbing a stress caused by pressure-reduction in the bottle with its uniform deformation.

Recently, as vessels for soft drink or the like, there have been commonly used synthetic resin, for example, polyethylene terephthalate made blow molded bottles (so-called PET bottles).

The bottle of this kind is filled with a liquid filler which is previously heated, for example, at 85° C. for pasteurization, being sealed, and is cooled. At tills time, the volume of the liquid filler is reduced by the cooling, resulting in the pressure-reduction in the bottle.

The pressure-reduction in the bottle is liable to deform the wall of the barrel portion of the bottle. To prevent the deformation of the wall, it may be considered to increase the wall thickness of the bottle for enhancing its strength. This method, however, is inconvenient in increasing the amount of the molding material for the bottle, thereby bringing a rise in production cost.

To prevent the deformation of the bottle without the above-mentioned inconvenience, there have been made a variety of attempts of providing a panel on the barrel portion of the bottle. In general, such a panel has been designed to be formed with irregularities or ribs for adsorbing the attraction caused by the pressure-reduction in the bottle and for providing a strength against the deformation.

As one example of the above attempts, there has been proposed a bottle in Japanese Patent Laid-open No. sho 62-52032 by the present applicant.

In this example, the barrel portion of a bottle has a recessed panel surface falling in from the surroundings, wherein the recessed panel surface is reinforced with horizontally crossing reinforcing ribs. With this construction, the recessed panel surface uniformly falls inside the bottle accompanied by the pressure-reduction in the bottle, and the reinforcing ribs function to suppress the excessive falling and hence to prevent the deformation of the bottle.

The bottle with the conventional panel design has a considerably high strength; however, in the field of the synthetic resin made bottle, particularly, of the PET bottle, there has been demanded a blow molded bottle having further higher strength in compliance with the difference in the size and shape of the bottle.

In particular, the PET bottle can be molded to be extremely thinned depending on the material property, but it encounters such a problem that the strength of the bottle is reduced with a decrease In thickness.

SUMMARY OF THE INVENTION

Taking the above circumstances into consideration, the present invention has been made, and its object is to provide a synthetic resin made bottle including a panel capable of being uniformly fallen in against the pressure-reduction in the bottle and having a suitable strength.

According to the present invention, the bottle includes a bottom portion, a barrel portion defined by a wall surface extending upwardly from the outer peripheral edge of the bottom portion, a mouth portion formed at the upper portion of the barrel portion, and a panel portion provided on the barrel portion.

The above panel portion includes a smooth surface portion without any irregularity, and a plurality of recessed portions each having a recessed panel surface falling in from the smooth surface portion to the inside of the barrel portion by a specified stepped dimension.

Each of the above recessed portions is disposed at an equal interval along the circumferential direction of the barrel portion, and which is formed into an approximately rectangular shape with four sides at boundaries between the smooth surface portion and the same, wherein two of the four sides lying along the longitudinal axis are protruded in an circular-arc shape outwardly of the recessed portion. Consequently, a column-like portion of the smooth surface portion between the adjacent recessed portions is narrower at the vertical central portion as compared with the upper and lower portions thereof, thereby enhancing the physical strength.

Further, the above recessed panel surface includes a plurality of swelling bodies which swell outwardly of the recessed panel surface.

The present invention may be carried out in various modifications.

For example, the above recessed portion may be formed into a longitudinal and approximately rectangular shape having long along the longitudinal axis with the mouth portion.

Also, the above recessed portion may include a stepped rib along the inside of each longitudinal side.

A plurality of the above swelling bodies may be arranged along the longitudinal axis, and further, may be juxtaposed in the above axis so as to be perpendicular to the axis.

Each of a plurality of the swelling bodies may be formed to have a substantially flat upper end surface, and further, may be formed into a polygonal cone such as a triangular, rectangular, pentagonal or more cone without the flat upper end surface.

Further, preferably, the above swelling body is formed into a rectangular shape; but may be formed into a circular, triangular or the other polygonal shape.

The above swelling body, in terms of the strength, preferably has a peripheral edge side surface continuous from the peripheral edge of the upper end surface to the recessed panel surface, wherein the peripheral edge side surface is tapered. Namely, the above swelling body preferably has a trapezoidal sectional shape.

Grooves may be provided on the smooth surface portion between a plurality of the above recessed portions in such a manner as to extend along the longitudinal axis. By the presence of the grooves, the strength of the smooth surface portion is enhanced.

In the case that the bottle is filled with the heated liquid, sealed, and then cooled, the bottle of the invention undergoes pressure-reduction in the bottle, and, the recessed panel surface is uniformly attracted.

Next, with the aid of a plurality of the swelling bodies formed in the recessed portion, the stress concentration is dispersed. Further, with a plurality of grooves provided on the outer peripheral wall surface portions between a plurality of recessed portions in a manner as to extend along the longitudinal axis, a strength against negative pressure is increased.

Since the sides lying in the longitudinal axis are protruded in a circular-arc shape outwardly of the recessed portion, the strength of the column-like portion formed from the smooth surface portion between the adjacent recessed portions is enhanced.

Polyethylene terephthalate is preferably used as the material for the bottom, however, other synthetic resins capable of being blow molded may be used.

BRIEF DESCRIPTION OF THE DRAWINGS

FIG. 8 is a view showing the wall thickness distribution of the bottle according to the first embodiment as shown in FIG. 1;

DETAILED DESCRIPTION OF THE PREFERRED EMBODIMENT

Hereinafter, embodiments of the present invention will be described with reference to the accompanying drawings.

Figure 1:
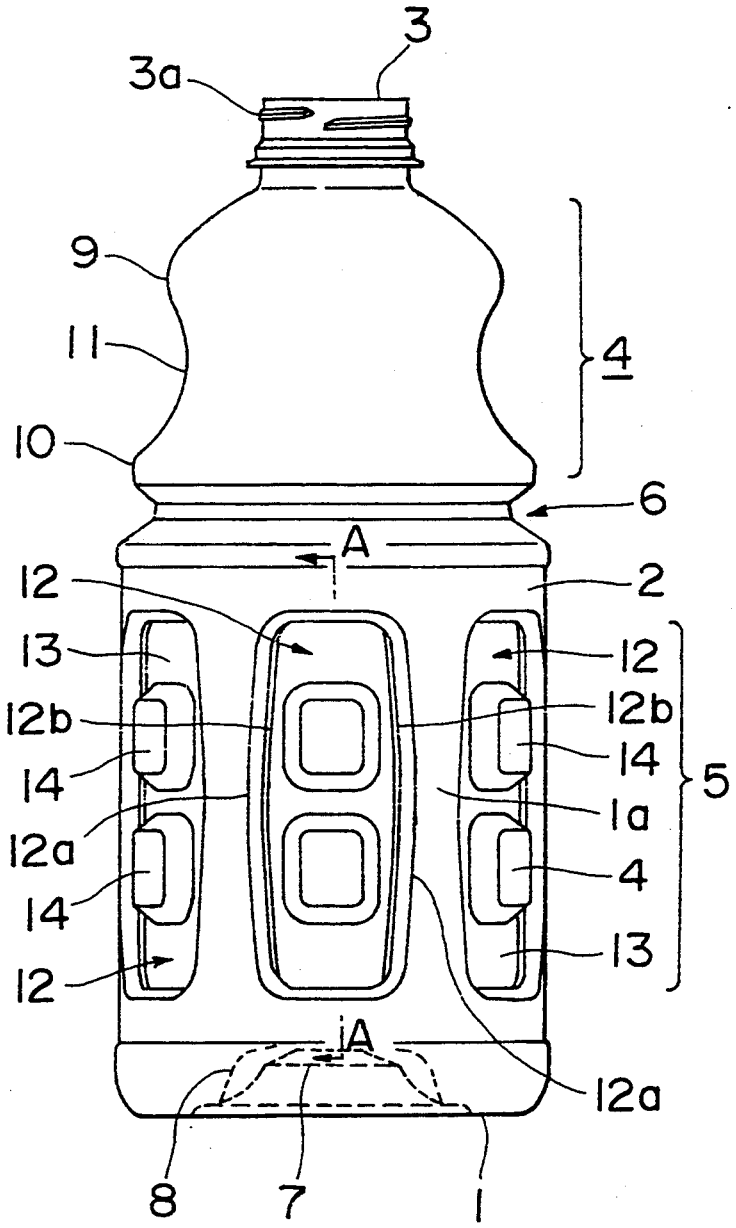
FIG. 1 is a front view of a bottle according to a first embodiment of the present invention.

FIG. 1 shows a blow molded bottle made of polyethylene terephthalate according to a first embodiment of the present invention.

In this embodiment, the bottle includes a circular bottom portion 1, and a barrel portion 2 defined by an outer peripheral wall surface upwardly extending from the outer peripheral edge of the bottom portion 1. The barrel portion 2 includes a mouth portion 3 positioned at upper end in a manner to be opened, an upper barrel portion 4 positioned on the mouth portion 3 side, and a lower barrel portion 5 positioned on the bottom portion 1 side. The upper barrel portion 4 and the lower barrel portion 5 are continuous to each other through a recessed groove shaped waist rib 6. In this construction, the lower barrel portion 5 serves as a panel portion.

Figure 2:
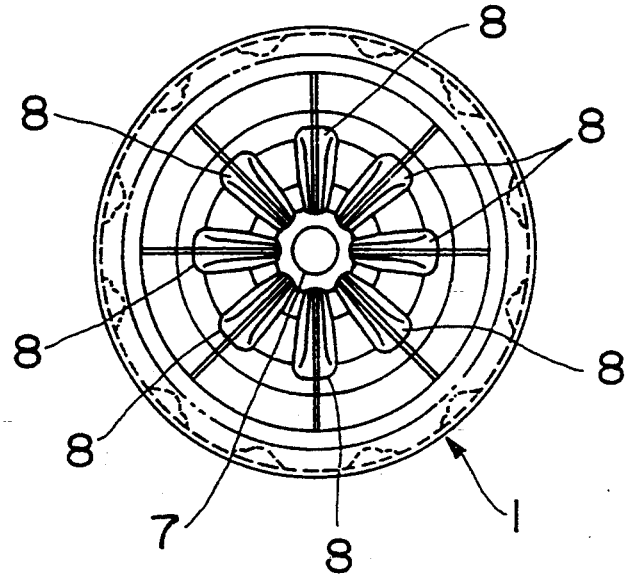
FIG. 2 is a bottom view of the first embodiment as shown in FIG. 1.

FIG. 2 is a bottom view of the bottom according to this embodiment, wherein the bottom portion 1 is formed in such a manner that the bottom surface is upwardly raised in three steps intermittently from the outer peripheral edge to the central portion 7 of the bottle. Further, on the bottom portion 1, approximately rectangular reinforcing bottom ribs 8, 8, . . . are provided in a manner as to be spaced from each other in equal intervals along the circumferential direction, to radially extend from the center of the bottom portion 1 to the outer peripheral edge of the bottle, and to project inside the bottle.

Figure 3:
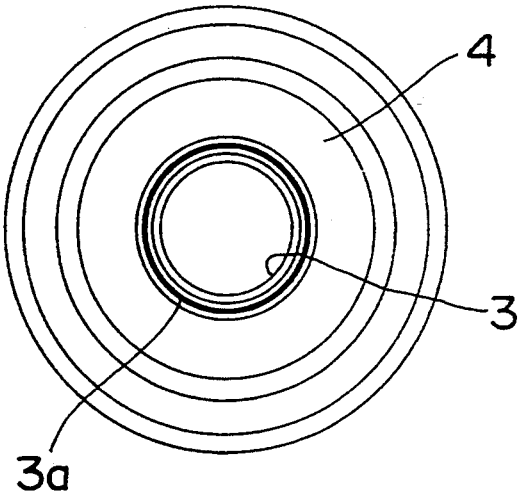
FIG. 3 is a top view off the first embodiment as shown in FIG. 1.

FIG. 3 is a top view of the bottle according to this embodiment, wherein a screw thread 3*a* is formed on the outer peripheral surface of the mouth portion 3, to which a cap (not shown) is screwed.

Returning to FIG. 1, the upper barrel portion 4 has a smooth curved shape between the mouth portion 3 and the waist rib 6, and which is constituted of a first curving projection 9 having a loose round R which is positioned on the mouth 3 side, a second curving projection 10 having a sharp round R which is positioned on the waist rib 6 side, and a curving recessed portion 11 having a looser round R which is positioned between the first and second curving projections 9 and 10.

The lower barrel portion, that is, the panel portion will be described below. The above panel portion has a smooth surface portion 1*a* without any irregularity.

The smooth surface portion 1*a* includes six pieces of recessed portions 12 spaced from each other along the circumferential direction of the barrel portion 2. Each recessed portion 12 is formed into a longitudinal and approximately rectangular shape along the bottle length direction, equivalent to the longitudinal axis. In the recessed portions 12, sides 12*a* lying in the longitudinal axis are respectively protruded in a circular-arc shape outwardly of the recessed portion 12, as a result of which each column-like portion formed of the smooth surface portion 1*a* between the adjacent recessed portions 12 is narrowest at a vertically intermediate portion. Such a shape brings higher strength against an applied stress.

in the above recessed portion, a stepped rib 12*b* is provided along the inside of each side 12*a* lying in the longitudinal axis. The stepped ribs 12*b* are effective to reinforce the strength of the column-like portion formed of the smooth surface portion 1*a* between the adjacent recessed portions 12.

Figure 4:
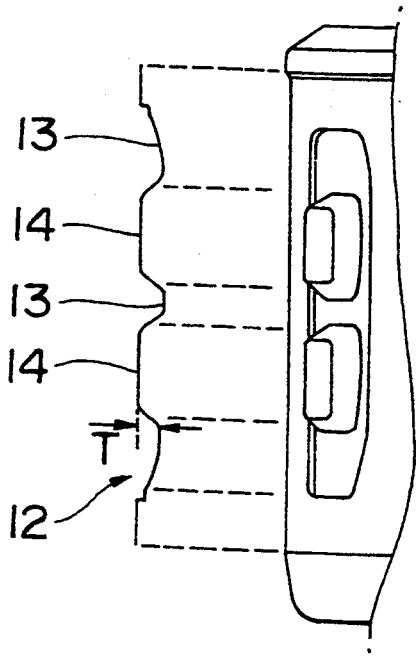
FIG. 4 is a sectional view taken along the line A—A of a lower barrel portion of the first embodiment as shown in FIG. 1.

FIG. 4 is a sectional view taken along the line A—A of the lower barrel portion 5 as shown in FIG. 1. Referring to this figure, each recessed portion 12 is constituted of recessed panel surfaces 13 which fall in from the smooth surface portion 1*a* of the barrel 2 by a stepped dimension T (mm), and two pieces of swelling bodies 14 and 14 which swell from the recessed panel surfaces 13 by a height of T (mm) in the outer peripheral direction of the bottle.

It should be obvious from the spirit of the present invention that each shape of the recessed portion 12 and the swelling bodies 14 is not restricted by the above approximately rectangular shape.

Two pieces of the swelling bodies 14 and 14, each being formed into an approximately trapezoidal shape having a flat and approximately rectangular upper end surface, are longitudinally disposed along the length direction of the bottle in a spaced apart manner. The recessed panel surface 13 positioned between two pieces of the swelling bodies 14 and 14 is made flat, and the recessed panel surfaces 13 positioned between the barrel portion 2 and two pieces of the swelling bodies 14 and 14 are tapered. Also, two pieces of swelling bodies 14 and 14 are positioned in the vicinity of the central portion in the recess portion 12. Accordingly, the recessed panel surface 13 positioned between two pieces of swelling bodies 14 and 14 is shorter in the length along the length of the bottle than the recessed panel surfaces 13 positioned between the barrel portion 2 and two pieces of the swelling bodies 14 and 14.

In addition, the above waist rib 6 is constricted with a specified radius, to be formed into a recessed groove shape between the second curving projection 10 and the upper end side of the lower barrel portion 5.

Figure 5:
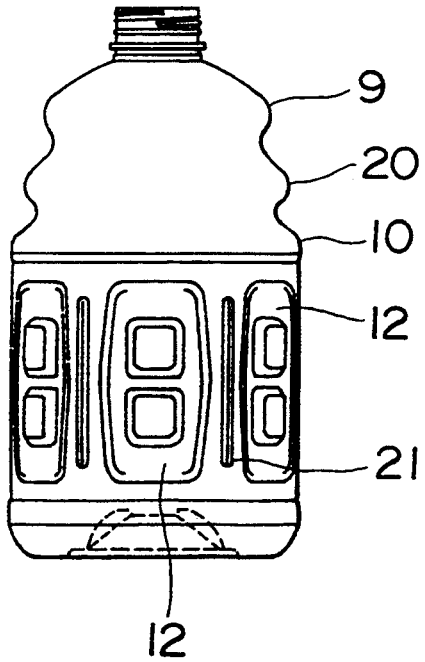
FIG. 5 is a front view of a bottle according to a second embodiment of the present invention.

FIG. 5 is a front view of a bottle according to a second embodiment of the present invention. This embodiment modifies part of the first embodiment, and therefore, parts with the same functions are designated at the same reference characters.

Referring to FIG. 5, an upper barrel portion 4 of the bottle is additionally provided with a third curving projection 20 at the central portion of a curving recessed portion 11 positioned between first and second curving projections 9 and 10. The radii of these first, third and second curving projections 9, 20 and 10 become steppedly larger in this order.

Also, each longitudinal groove 21 is formed along the length of the bottle at the portion between adjacent recessed portions 12 and 12 of the barrel portion In addition, a smooth surface portion 1*a* is stuck with a label or the like covering a panel portion. The panel portion 1*a* has no irregularity at all, which makes labeling easy by only sticking the label on the smooth surface portion.

Hereinafter, there will be described the results of the comparative experiment for the bottles according to the first and second embodiments of the present invention and a comparative bottle having the other panel design.

Figure 11:
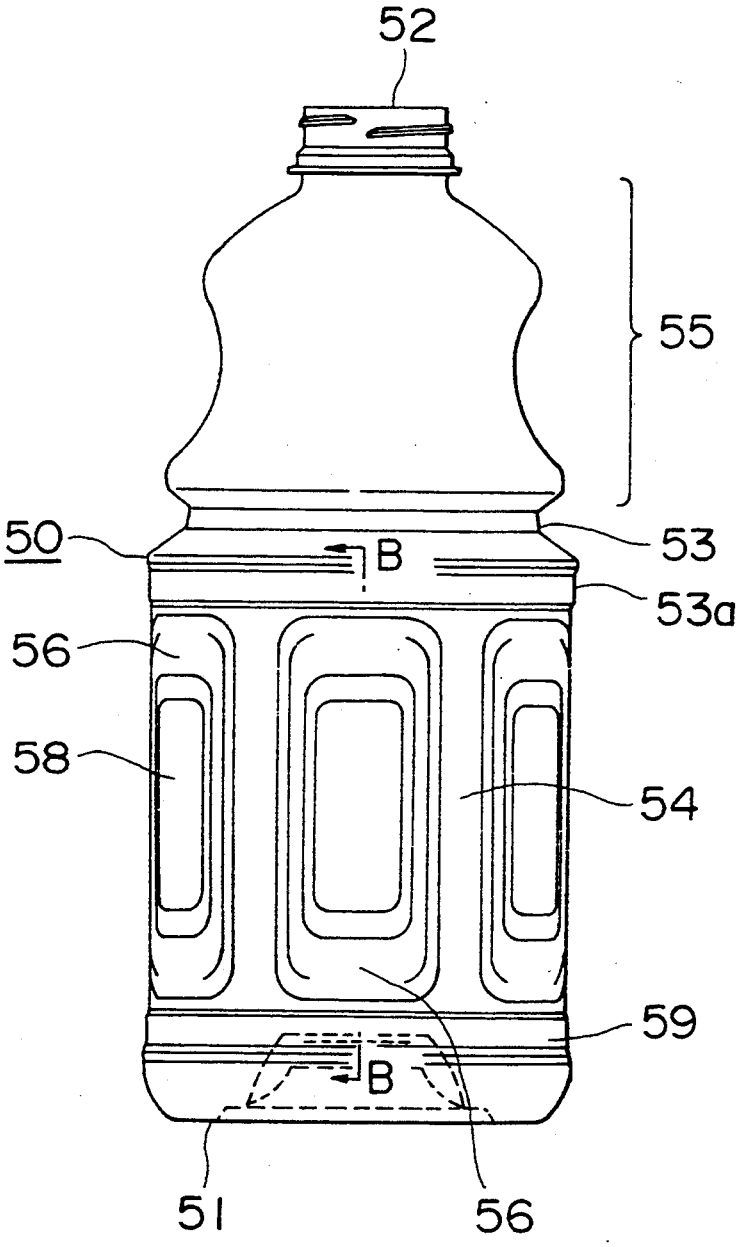
FIG. 11 is a front view of the comparative bottle.
Figure 12:
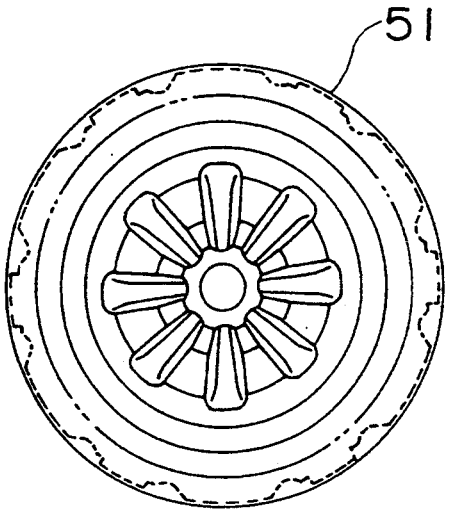
FIG. 12 is a bottom view of the comparative bottle as shown in FIG. 11.
Figure 13:
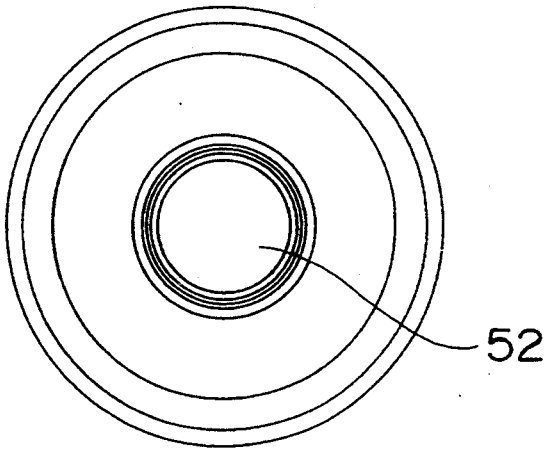
FIG. 13 is a top view of the comparative view as shown in FIG. 11.
Figure 14:
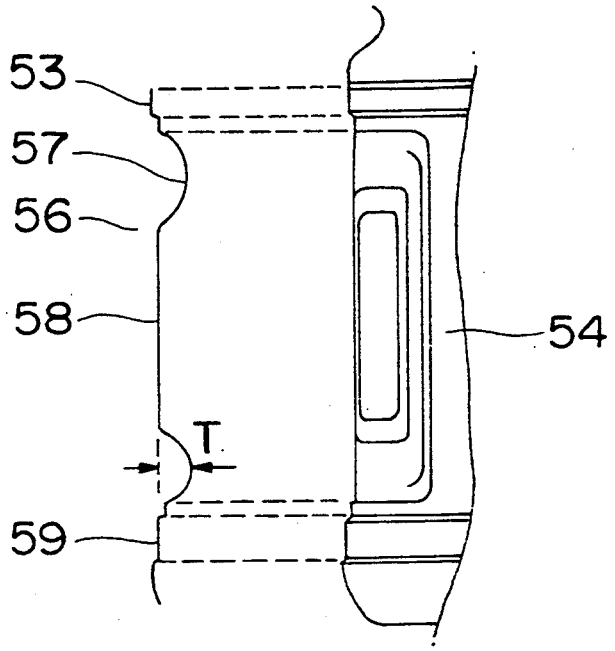
FIG. 14 is a sectional view taken along the line B—B of a lower barrel portion of the comparative bottle as shown in FIG. 11.

FIG. 11 is a front view of a comparative bottle; FIG. 12 is a bottom view of FIG. 11; FIG. 13 is a top view of FIG. 11; and FIG. 14 is a sectional view taken along the line B—B of FIG. 11. As shown in these figures, the comparative bottle 50 includes a circular bottom portion 51, a mouth portion 52 which extends upwardly from the outer peripheral edge of the bottom portion 51 and is removably covered with a cap (not shown), and a barrel portion having a panel surface 54 being a lower barrel surface positioned on the bottom portion 51 side through a waist rib 53 and an upper barrel portion 55 positioned on the mouth 52 side. Further, the panel surface 54 includes a recessed panel surface 57 falling in by a specified stepped dimension T (mm) and a single swelling body 58 which swells outwardly from the recessed panel surface 57.

A labeling stepped portion 53*a* is provided between the waist rib 53 and the panel surface 54, and which has an outside diameter larger than that of the panel surface 54. Further, a lower side labeling stepped portion 59 having the same shape as the labeling stepped portion 53*a* is formed on the lower side of the panel surface 54. A label (not shown) is stuck on the labeling stepped portion 53*a* and the lower labeling stepped portion 59 having the same shape, to thus cover the panel surface.

First, the inspection results for sizes of the bottle according to the first embodiment of the present invention is listed in Table 1, and the inspection results for the comparative bottle is listed in Table 2.

TABLE 1

| | VALUE IN DRAWING | DIFFERENCE | AVERAGE | | 1 | 2 | 3 | 4 | 5 |
|---|---|---|---|---|---|---|---|---|---|
| DIAMETER AT A | 89.33 | 1.642 | 87.69 | PLa | 87.57 | 88.01 | 87.40 | 87.27 | 87.38 |
| | | | | PLb | 87.58 | 88.48 | 87.91 | 87.73 | 87.55 |
| | | | | ϕ | 87.58 | 88.25 | 87.66 | 87.50 | 87.47 |
| DIAMETER AT B | 78.16 | −0.033 | 78.13 | PLa | 77.88 | 77.51 | 77.42 | 77.40 | 77.55 |
| | | | | PLb | 78.43 | 78.95 | 78.85 | 78.74 | 78.54 |
| | | | | ϕ | 78.16 | 78.23 | 78.14 | 78.07 | 78.05 |
| DIAMETER AT C | 107.44 | −2.010 | 105.43 | PLa | 105.34 | 107.08 | 104.84 | 104.44 | 104.51 |
| | | | | PLb | 105.20 | 107.50 | 105.51 | 105.19 | 104.69 |
| | | | | ϕ | 105.27 | 107.29 | 105.18 | 104.82 | 104.60 |
| DIAMETER AT D | 94.47 | 1.042 | 95.51 | PLa | 95.80 | 96.56 | 95.26 | 95.61 | 95.15 |
| | | | | PLb | 94.99 | 96.32 | 95.36 | 95.19 | 94.88 |
| | | | | ϕ | 95.40 | 96.44 | 95.31 | 95.40 | 95.02 |
| DIAMETER AT E | 116.41 | 0.109 | 116.52 | PLa | 117.00 | 117.17 | 116.81 | 116.66 | 116.68 |
| | | | | PLb | 115.92 | 116.74 | 116.12 | 115.91 | 116.18 |
| | | | | ϕ | 116.46 | 116.96 | 116.47 | 116.29 | 116.43 |
| DIAMETER AT F | 114.01 | 1.156 | 115.17 | 1 | 116.46 | 115.98 | 116.22 | 116.13 | 115.92 |
| | | | | 2 | 114.09 | 114.70 | 113.98 | 110.01 | 114.17 |
| | | | | ϕ | 115.28 | 115.34 | 115.10 | 115.07 | 115.05 |
| DIAMETER AT G | 114.01 | −0.679 | 113.33 | 1 | 114.44 | 114.75 | 114.74 | 114.12 | 114.21 |
| | | | | 2 | 112.42 | 113.51 | 112.29 | 112.62 | 112.24 |
| | | | | 3 | 112.38 | 113.09 | 112.88 | 113.11 | 113.17 |
| | | | | ϕ | 113.08 | 113.78 | 113.30 | 113.28 | 113.21 |
| DIAMETER AT H | 114.01 | −2.641 | 111.37 | 1 | 111.65 | 112.67 | 111.67 | 111.58 | 111.08 |
| | | | | 2 | 109.84 | 110.58 | 109.42 | 110.08 | 110.48 |
| | | | | 3 | 112.01 | 112.42 | 112.52 | 112.19 | 112.34 |
| | | | | ϕ | 111.17 | 111.89 | 111.20 | 111.28 | 111.30 |
| DIAMETER AT I | 114.01 | −3.308 | 110.70 | 1 | 111.42 | 112.07 | 111.07 | 110.84 | 110.62 |
| | | | | 2 | 109.34 | 109.91 | 108.79 | 109.74 | 109.90 |
| | | | | 3 | 111.43 | 111.79 | 112.21 | 111.63 | 112.28 |
| | | | | ϕ | 110.39 | 110.85 | 110.50 | 110.69 | 111.09 |
| DIAMETER AT J | 114.01 | −0.004 | 114.01 | 1 | 114.67 | 114.53 | 114.89 | 114.49 | 114.53 |
| | | | | 2 | 113.35 | 113.76 | 113.22 | 113.27 | 113.35 |
| | | | | ϕ | 114.01 | 114.15 | 114.06 | 113.88 | 113.94 |
| DIAMETER AT K | 116.41 | −0.118 | 116.29 | PLa | 116.62 | 116.70 | 116.71 | 116.49 | 116.52 |
| | | | | PLb | 115.73 | 116.45 | 115.71 | 115.95 | 116.04 |
| | | | | ϕ | 116.18 | 116.58 | 116.21 | 116.62 | 116.28 |
| WEIGHT (g) | 75 | −0.40 | 74.60 | | 74.06 | 74.68 | 74.77 | 74.79 | 74.70 |
| HEIGHT (mm) | 267.03 | 1.16 | 268.19 | | 268.07 | 268.23 | 268.23 | 268.13 | 268.27 |
| FULL FILLED CAPACITY (ml) FILLED | 1970 | −36.72 | 1933.28 | | 1925.30 | 1955.96 | 1927.28 | 1926.89 | 1930.97 |

TABLE 1-continued

| | VALUE IN DRAWING | DIFFERENCE | AVERAGE | 1 | 2 | 3 | 4 | 5 |
|---|---|---|---|---|---|---|---|---|
| CAPACITY (ml) | | | | | | | | |

◎ FILLED CAPACITY: FILLED AT 85° C. HS 15 ml

TABLE 2

| | VALUE IN DRAWING | DIFFERENCE | AVERAGE | | 1 | 2 | 3 | 4 | 5 |
|---|---|---|---|---|---|---|---|---|---|
| DIAMETER AT A | 90.93 | 1.470 | 89.46 | PLa | 89.27 | 89.60 | 89.27 | 89.36 | 89.10 |
| | | | | PLb | 89.65 | 89.73 | 89.54 | 89.70 | 89.38 |
| | | | | ϕ | 89.46 | 89.67 | 89.41 | 89.53 | 89.24 |
| DIAMETER AT B | 79.76 | 0.347 | 80.11 | PLa | 79.68 | 80.23 | 79.79 | 79.63 | 79.80 |
| | | | | PLb | 80.43 | 80.30 | 80.32 | 80.48 | 80.41 |
| | | | | ϕ | 80.06 | 80.27 | 80.06 | 80.06 | 80.11 |
| DIAMETER AT C | 107.44 | 1.534 | 105.91 | PLa | 105.69 | 106.75 | 105.40 | 105.83 | 104.97 |
| | | | | PLb | 106.22 | 106.59 | 106.07 | 106.32 | 105.22 |
| | | | | ϕ | 105.96 | 106.67 | 105.74 | 106.08 | 105.10 |
| DIAMETER AT D | 93.47 | 1.424 | 94.89 | PLa | 94.82 | 95.64 | 94.59 | 94.88 | 94.62 |
| | | | | PLb | 94.88 | 94.99 | 94.84 | 95.01 | 94.67 |
| | | | | ϕ | 94.85 | 95.32 | 94.72 | 94.95 | 94.65 |
| DIAMETER AT E | 116.33 | −0.047 | 116.28 | PLa | 116.80 | 116.83 | 116.72 | 116.84 | 116.30 |
| | | | | PLb | 115.82 | 115.65 | 116.02 | 116.05 | 115.80 |
| | | | | ϕ | 116.31 | 116.24 | 116.37 | 116.45 | 116.05 |
| DIAMETER AT F | 114.81 | 0.634 | 115.44 | 1 | 116.02 | 116.21 | 115.95 | 116.12 | 115.72 |
| | | | | 2 | 114.75 | 114.70 | 115.02 | 115.14 | 114.81 |
| | | | | ϕ | 115.39 | 115.46 | 115.49 | 115.63 | 115.27 |
| DIAMETER AT G | 114.81 | −0.653 | 114.16 | 1 | 114.47 | 114.17 | 114.88 | 114.63 | 114.33 |
| | | | | 2 | 113.80 | 114.01 | 113.93 | 114.41 | 114.37 |
| | | | | 3 | 114.08 | 113.45 | 114.31 | 113.69 | 113.82 |
| | | | | ϕ | 114.12 | 113.88 | 114.37 | 114.24 | 114.17 |
| DIAMETER AT H | 114.81 | 1.163 | 113.65 | 1 | 115.12 | 114.04 | 114.78 | 114.55 | 114.46 |
| | | | | 2 | 114.36 | 114.64 | 114.63 | 114.48 | 114.38 |
| | | | | 3 | 112.13 | 112.16 | 111.74 | 112.25 | 110.99 |
| | | | | ϕ | 113.87 | 113.61 | 113.72 | 113.76 | 113.28 |
| DIAMETER AT J | 114.81 | 0.202 | 115.01 | 1 | 115.44 | 115.34 | 115.44 | 115.50 | 114.97 |
| | | | | 2 | 114.88 | 114.55 | 114.49 | 114.71 | 114.80 |
| | | | | ϕ | 115.16 | 114.95 | 114.97 | 115.11 | 114.89 |
| DIAMETER AT K | 116.33 | 0.271 | 116.60 | PLa | 116.90 | 116.65 | 116.92 | 116.81 | 116.31 |
| | | | | PLb | 116.67 | 116.41 | 116.39 | 116.43 | 116.52 |
| | | | | ϕ | 116.79 | 116.53 | 116.66 | 116.62 | 116.42 |
| WEIGHT (g) | 75 | 0.46 | 74.54 | | 74.69 | 74.42 | 74.58 | 74.21 | 74.79 |
| HEIGHT (mm) | 267.03 | −0.10 | 266.93 | | 266.79 | 266.64 | 267.23 | 266.90 | 267.11 |
| FULL FILLED CAPACITY (ml) | 1970 | 19.43 | 1950.57 | | 1956.67 | 1947.04 | 1957.34 | 1949.98 | 1941.83 |
| FILLED CAPACITY (ml) | | | | | | | | | |

◎FILLED CAPACITY: FILLED AT 85° C. HS 15 ml

Figure 6:
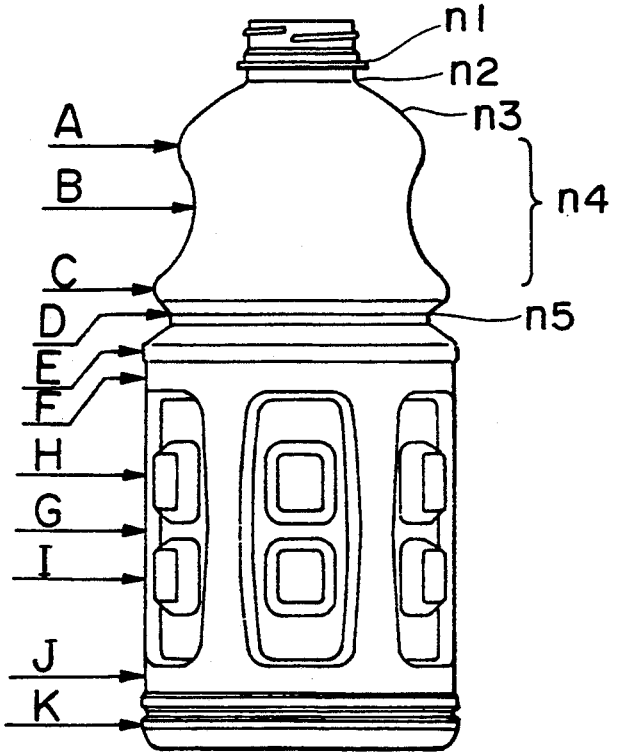
FIG. 6 is a view showing the positions subjected to the size inspection in the bottle according to the first embodiment as shown in FIG. 1.
Figure 7:
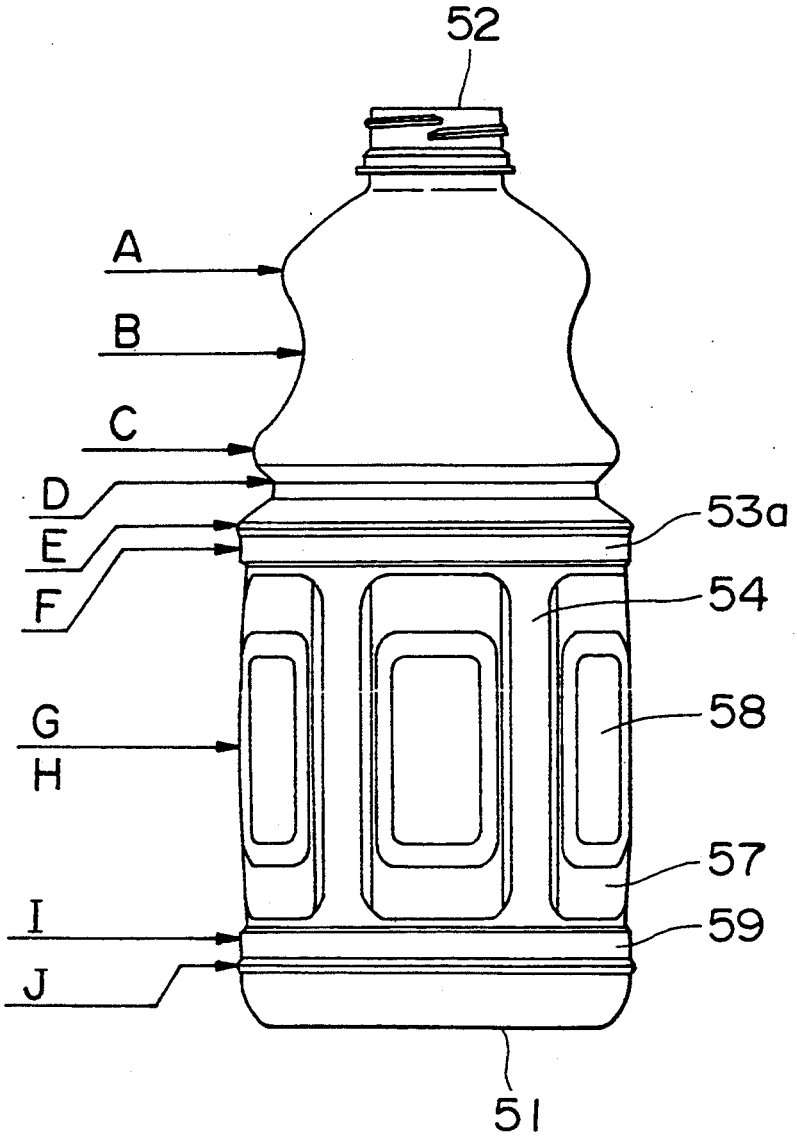
FIG. 7 is a view showing the positions subjected to the size inspection in a comparative bottle.
Figure 9C:
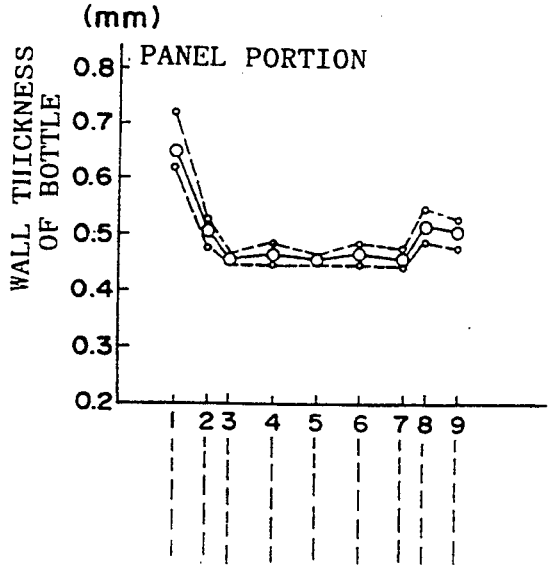
FIG. 9 is a view showing the wall thickness of the comparative bottle.
Figure 9B:
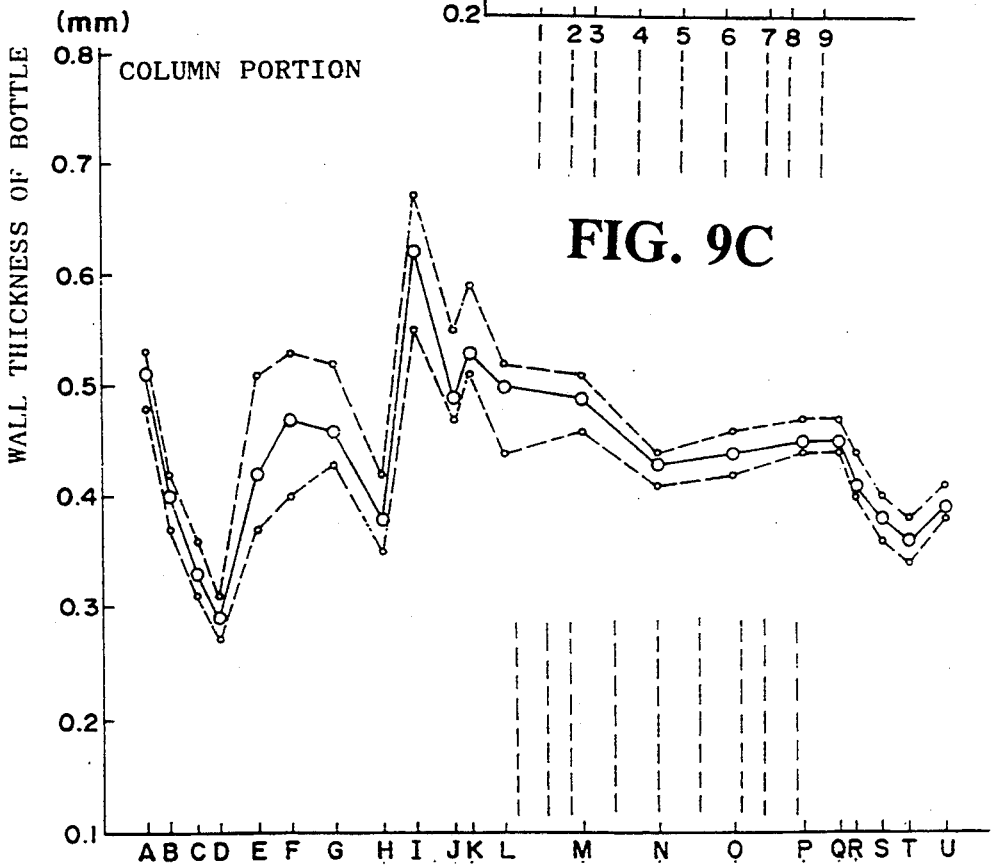
Figure 9A:
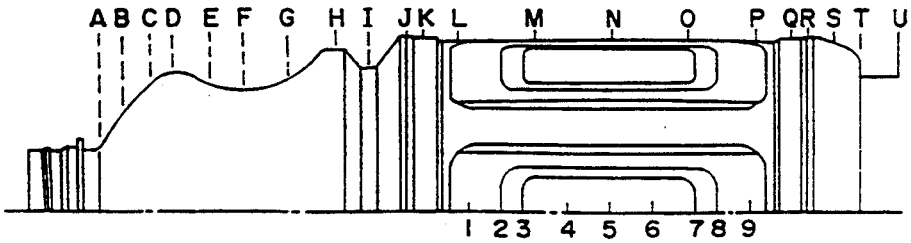

The measured positions of the bottles having the values as listed in Tables 1 and 2 are shown in FIGS. 6 and 7, respectively. As shown in FIGS. 8 and 9, the bottle of the first embodiment is nearly similar in the wall thickness distribution to the comparative bottle.

Figure 10:
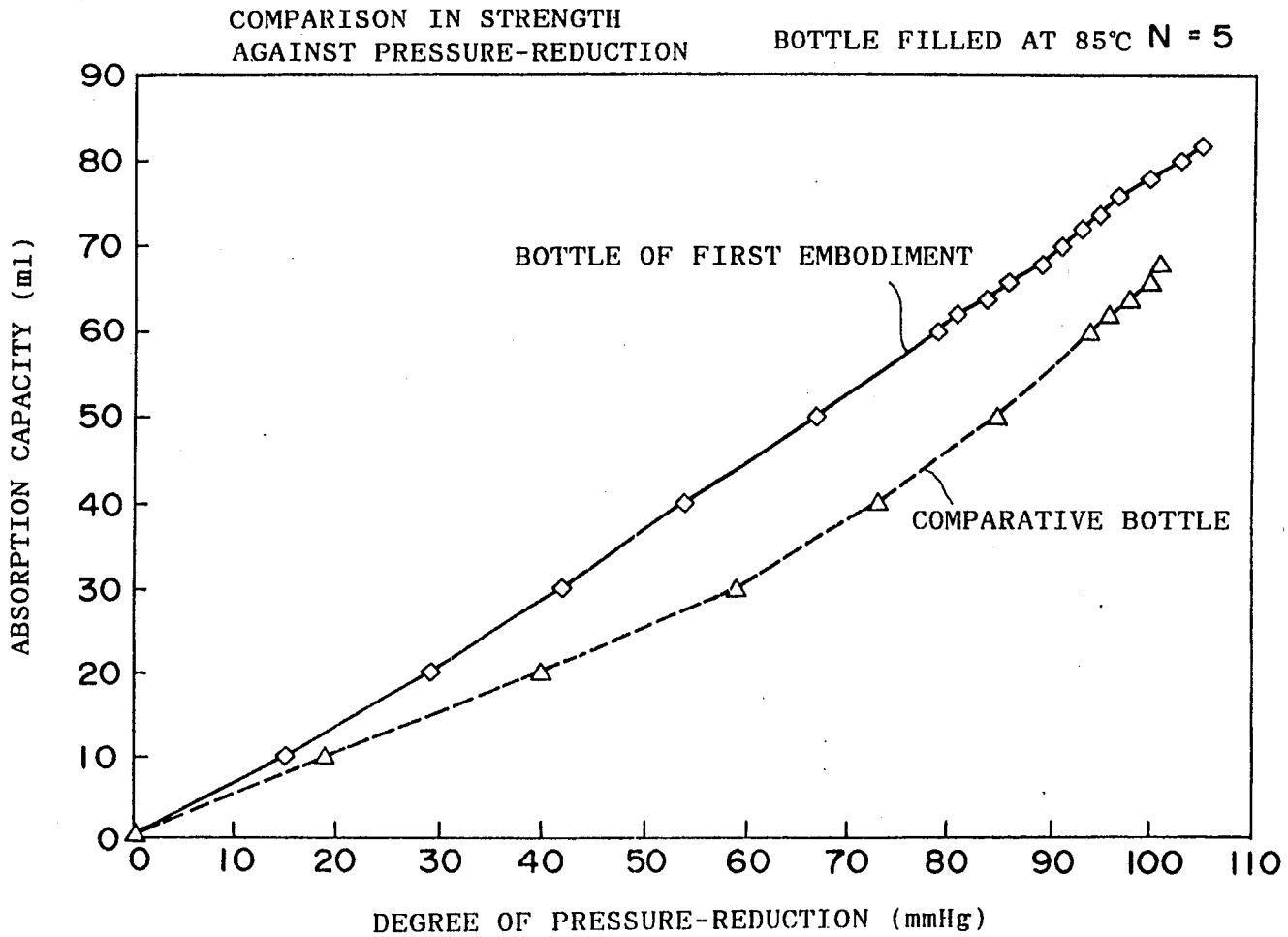
FIG. 10 is a view showing the results of the pressure-reduction test in the bottle of the first embodiment as shown in FIG. 1 and the comparative bottle.

The bottle of each size was subjected to the pressure-reduction test for examining strength against pressure-reduction. FIG. 10 shows the results. As clear from FIG. 10, in the comparative bottle, the panel portion is not uniformly attracted at an absorption capacity of about 68 (ml) with a degree of pressure-reduction of about 101 (mmHg), whereas in the first embodiment, the panel portion uniformly changed up to an absorption capacity of about 82 (ml) with a degree of pressure-reduction of about 105 (mmHg). Accordingly, the bottle of the present invention is increased in capacity by about 20% as compared with the comparative bottle.

In addition, Table 3 shows the data corresponding to the values of FIG. 10.

TABLE 3

| ABSORPTION CAPACITY (ml) | DEGREE OF PRESSURE-REDUCTION (mmHg) PRESENT BOTTLE | COMPARATIVE BOTTLE |
|---|---|---|
| 0 | 0 | 0 |
| 2 | | |
| 4 | | |
| 6 | | |
| 8 | | |
| 10 | 15 | 19 |
| 12 | | |
| 14 | | |
| 16 | | |
| 18 | | |
| 20 | 29 | 40 |
| 22 | | |
| 24 | | |
| 26 | | |
| 28 | | |
| 30 | 42 | 59 |
| 32 | | |
| 34 | | |
| 36 | | |
| 38 | | |
| 40 | 54 | 73 |
| 42 | | |
| 44 | | |
| 46 | | |

TABLE 3-continued

| ABSORPTION CAPACITY (ml) | DEGREE OF PRESSURE-REDUCTION (mmHg) PRESENT BOTTLE | COMPARATIVE BOTTLE |
|---|---|---|
| 48 | | |
| 50 | 67 | 85 |
| 52 | | |
| 54 | | |
| 56 | | |
| 58 | | |
| 60 | 79 | 94 |
| 62 | 81 | 96 |
| 64 | 84 | 98 |
| 66 | 86 | 100 |
| 68 | 89 | 101 |
| 70 | 91 | |
| 72 | 93 | |
| 74 | 95 | |
| 76 | 97 | |
| 78 | 100 | |
| 80 | 103 | |
| 82 | 105 | |
| 84 | | |
| 86 | | |
| 88 | | |
| 90 | | |

Tables 4 to 6 show the results of the buckling test for the bottles of the first and second embodiments and the comparative bottle, respectively. In addition, as the filled bottles, bottles filled at 85° were used.

TABLE 4

(N = 3)

| | Avg | Max | Min | BUCKLING POSITION |
|---|---|---|---|---|
| EMPTY BOTTLE | | | | |
| STRENGTH (kg) | 46.7 | 47.1 | 46.2 | NECK LOWER |
| DISPLACEMENT (mm) | 7.6 | 7.9 | 7.4 | PORTION |
| FILLED BOTTLE | | | | |
| STRENGTH (kg) | 45.8 | 53.0 | 35.3 | NECK LOWER |
| DISPLACEMENT (mm) | 7.7 | 11.0 | 4.9 | PORTION |

TABLE 5

| | Avg | Max | Min | BUCKLING POSITION |
|---|---|---|---|---|
| EMPTY BOTTLE | | | | |
| STRENGTH (kg) | 24.3 | 25.8 | 21.8 | BELL PORTION |
| DISPLACEMENT (mm) | 5.7 | 5.8 | 5.3 | (n = 3) |
| FILLED BOTTLE | | | | |
| STRENGTH (kg) | 65.0 | 69.7 | 57.2 | NECK LOWER |
| DISPLACEMENT (mm) | 15.6 | 17.6 | 12.3 | PORTION (n = 4) |

TABLE 6

| | Avg | Max | Min | BUCKLING POSITION |
|---|---|---|---|---|
| EMPTY BOTTLE | | | | |
| STRENGTH (kg) | 27.0 | 29.6 | 24.8 | BELL PORTION |
| DISPLACEMENT (mm) | 5.8 | 6.5 | 5.1 | (n = 3) |
| FILLED BOTTLE | | | | |
| STRENGTH (kg) | 65.9 | 71.0 | 59.5 | NECK LOWER |
| DISPLACEMENT (mm) | 14.2 | 17.6 | 10.0 | PORTION (n = 4) |

In addition, the terms "neck lower portion" and "bell portion" appearing in tables are the technical terms used by persons skilled in the art, and the neck lower portion and the bell portion commonly indicate the portions of n2 and n4 in FIG. 6, respectively. Further, the portions of n1, n3 and n5 are called as the terms of "neck", "shoulder" and "waist", respectively. In this specification, these portions have been described as the upper barrel portion.

As a result of the above comparative experiment, it was revealed that the comparative bottle having only the single swelling body 58 in the recess portion is difficult to effectively prevent the bottle deformation due to the pressure-reduction caused by the temperature change.

In addition, in the case of sticking the label on the panel portion after molding the bottle, the labeling is troublesome in the comparative bottle. This is because the labeling must be made while crossing the labeling stepped portion 53*a* and the lower side labeling stepped portion 59 which are stepped from the panel surface 54.

For eliminate the above step, there was designed a comparative bottle having a shape without the labeling stepped portion 53*a* and the lower side labeling stepped portion 59; however, it was disadvantageous in that the strength of the panel was significantly reduced.

On the contrary, the bottle as shown in FIG. 1 has no step such as irregularity on the smooth surface portion. While the smooth surface portion has such a shape as omitting the labeling stepped portion 53*a* and the lower side labeling stepped portion 59 from the comparative bottle, it is not reduced in strength and is easy in labeling because of the above panel design.

As described above, according to the bottle structure of the present invention, the recessed panel portion is uniformly attracted against the pressure-reduction in the bottle, thereby preventing the deformation of the appearance of the bottle. Further, according to the panel shape of the present invention, the strength against the deformation is increased, which makes it possible to enhance the pressure-proof limit and hence to enlarge the absorption capacity in pressure-reduction. Accordingly, it is possible to provide a bottle having a high strength against pressure-reduction caused by the temperature change without substantially reducing the capacity of liquid filler. Therefore, the present invention is preferably applicable for a large sized bottle for 1 gallon (3.785 l) which is large in the degree of the pressure-reduction.

What is claimed is:

1. A bottle made of a synthetic resin comprising:

a bottom portion;

a mouth portion; and a barrel portion defined by a wall surface extending upwardly from an outer peripheral edge of said bottom portion to said mouth portion, said barrel portion including a panel portion having a smooth surface portion without any irregularity and a plurality of recessed portions equally distributed around a circumference of said barrel portion, each of said recessed portions having four sides at boundaries between said smooth surface portion and said recessed portion and defining a recessed panel surface extending radially inward from said smooth surface portion to the inside of the barrel portion by a specified stepped dimension, said recessed panel surface having a plurality of swelling bodies therein extending radially outward away from said recessed panel surface, wherein two of said four sides are longitudinal sides and extend along a longitudinal axis of the bottle and the other two of said four sides are transverse sides and extend along the circumference of the barrel portion transverse to the longitudinal axis, intersections of said transverse sides and said longitudinal sides forming corner portions, said longitudinal sides having a curved arcuate shape extending between adjacent ones of said corner portions to form longitudinally extending column-like portions between adjacent recessed portions, said column-like portions having a narrowest width at an intermediate longitudinal position.

2. The bottle according to claim 1, wherein said longitudinal sides are longer than said transverse sides.

3. The bottle according to claim 1, wherein a stepped longitudinal rib is provided within each said recessed portion substantially adjacent each of said longitudinal sides.

4. The bottle according to claim 1, wherein the plurality of swelling bodies are arranged along the longitudinal axis.

5. The bottle according to claim 1, wherein each of the plurality of swelling bodies has an approximately flat upper end surface.

6. The bottle according to claim 1, wherein each of said plurality of swelling bodies is formed into a rectangular shape.

7. The bottle according to claim 1, wherein each of said plurality of swelling bodies has a peripheral edge side surface continuous from a peripheral edge of said upper end surface to said recessed panel surface, said peripheral edge side surface being tapered.

8. The bottle according to claim 1, wherein longitudinally extending grooves are provided on said smooth surface portion between said recessed portions.

9. The bottle according to claim 1, wherein the recessed portions are provided around the swelling bodies.

10. The bottle according to claim 1, wherein said plurality of swelling bodies are longitudinally disposed in a spaced apart manner within each said recessed portion, the recessed panel surface located between adjacent swelling bodies is flat and the recessed panel surface between the barrel portion and the swelling bodies is tapered.

* * * * *